United States Patent [19]

Pilpel et al.

[11] 4,455,037

[45] Jun. 19, 1984

[54] LAMINATED SKI REINFORCEMENT MEMBERS

[75] Inventors: Edward Pilpel, Manchester; Franklin Meatto, Cromwell, both of Conn.

[73] Assignee: Olin Corporation, New Haven, Conn.

[21] Appl. No.: 318,190

[22] Filed: Nov. 4, 1981

[51] Int. Cl.[3] ..... A63C 5/12

[52] U.S. Cl. ..... 280/610

[58] Field of Search ..... 280/610, 601, 609; 428/545

[56] References Cited

U.S. PATENT DOCUMENTS

| | | | |
|---|---|---|---|
| 3,132,874 | 5/1964 | Baudou | 280/610 |
| 3,208,761 | 9/1965 | Sullivan | 280/610 |
| 3,276,784 | 10/1966 | Anderson, Jr. | 280/11.13 |
| 3,503,621 | 3/1970 | Scmidt | 280/610 |
| 3,635,482 | 1/1972 | Holman | 280/610 |
| 3,816,573 | 6/1974 | Hashimoto | 280/610 |
| 3,844,576 | 10/1974 | Schultes | 280/610 |
| 3,894,745 | 7/1975 | Heim | 280/610 |
| 3,902,732 | 9/1975 | Fosha | 280/610 |
| 3,918,731 | 11/1975 | Legrand | 280/610 |
| 3,933,362 | 1/1976 | Sakung | 280/610 |
| 3,940,157 | 2/1976 | Sakuma | 280/11.13 |
| 3,967,992 | 7/1976 | McCaskey | 280/610 |
| 4,007,946 | 2/1977 | Sarver | 280/660 |
| 4,093,268 | 6/1978 | Sampson | 280/610 |
| 4,135,732 | 1/1979 | Magnus | 280/610 |

FOREIGN PATENT DOCUMENTS

| | | | |
|---|---|---|---|
| 917688 | 12/1972 | Canada | 273/65 |
| 1467183 | 1/1967 | France | 280/610 |
| 631879 | 11/1949 | United Kingdom | 280/610 |

OTHER PUBLICATIONS

Dynastar Skis Advertisement.

*Primary Examiner*—Joseph F. Peters, Jr.
*Assistant Examiner*—Michael Mar
*Attorney, Agent, or Firm*—Ralph D'Alessandro; Donald F. Clements; Thomas P. O'Day

[57] ABSTRACT

In a downhill snow ski there are provided reinforcement rib members which are positioned generally perpendicularly to the top surface and the bottom running surface of the ski and are formed from a material of relatively high modulus with respect to the modulus of the core material to impart an increased rate of return and a controllably designed natural frequency to the ski.

13 Claims, 4 Drawing Figures

LAMINATED SKI REINFORCEMENT MEMBERS

BACKGROUND OF THE INVENTION

This invention relates to a ski structure, and more specifically, it is concerned with isotropic reinforcement rib members which extend between the top surface and the opposing bottom or running surface of the ski which permit two primary ski characteristics to be controllably increased dependent upon the type and quantity of reinforcement material utilized.

The continued popularity of downhill skiing has focused attention on the structure of skis to produce a ski that provides greater responsiveness to the improved skiing techniques being employed by skiers today and the increased speed being achieved as a result of these techniques. This continued popularity has caused the materials used in skis to be changed in the efforts to develop higher performance skis at lower manufacturing costs. Skis have been made solely from wood, composite wood-plastic materials, as well as entirely from plastics. Skis made entirely from metal have also been manufactured, as well as incorporating metal into composite wood-plastic skis or into all plastic skis. In particular, the advent of high performance wood-fiberglass and fiberglass-plastic foam skis has intensified the skiing industry's efforts to solve the problem of providing a ski constructed of quality materials which provides increased ski return rates, increased designable natural frequency, increased designable torsional rigidity, and a bottom steel running edge with increased impact resistance.

Different approaches have been taken in attempt to solve these problems as higher performance skis have evolved in the ski industry. Initially, skis were made with just a wooden core. For some time, a core made of plastic material, such as plastic foam or urethane, placed within a honeycomb structure formed from aluminum, has been employed. However, because of the higher performance nature of today's skis, these composite skis are subjected to greater flexibility strains which the aforementioned constructions have either failed to withstand or have provided skis which produce a dead sensation to the user. None of the aforementioned structures have provided skis which balance the considerations of high material costs, difficulty in contouring the skis during manufacture and other problems and inefficiencies that occur during the molding and assembly processes employed in the manufacture of snow skis today.

Additionally, to date the prior art ski designs have been ineffective at designing center spring ski constants comparable to those obtained in the high performance racing skis into the recreational skis of preselected lengths used by the general public while increasing the rate of return or snap. Recreational skis typically have been characterized as soft or flexible because they enabled skiers to make turns at relatively slow speeds. The stiff or nonflexible skis, typically utilized for alpine racing, are more difficult to get into a turn at the slower speeds normally achieved by recreational skiers. An increased rate of return or snap in a ski facilitates recovering from a turn. Thus, the optimum design for a recreational ski is one that is soft or flexible with a high rate of return that permits a recreational skier to initiate a turn at a relatively low speed by virtue of the ski's designed flexibility, but which also imparts a livelier feel to the skier and helps the ski recover from the turn because of a designably increased rate of return or snap comparable to that found in racing skis of greater stiffness and higher center spring constants.

The foregoing problems are solved in the design of the present invention by providing structure in a snow ski which creates an increased rate of return and a more lively feel at a lower overall spring constant to provide a quicker responding ski or one that provides a faster change in turning direction.

SUMMARY OF THE INVENTION

It is an object of the present invention to provide in a downhill snow ski high modulus reinforcement members that are incorporated into a relatively low modulus wood core to improve the performance characteristics of the ski.

It is another object of the present invention to provide a downhill snow ski structure that possesses a designably increased rate of return or snap and a more lively feel that is imparted to the skier at a lower overall center spring constant.

It is a further object of the present invention to provide an improved snow ski structure that increases the ski's designable natural frequency, designable torsional rigidity, and bottom steel edge impact resistance.

It is a feature of the present invention to provide at least a pair of reinforcement rib members made from a predetermined high modulus material extending between the top surface and the bottom running surface of the ski which enhances the performance characteristics of the ski.

It is another feature of the present invention to provide reinforcement rib members that offer increased resistance to the bottom steel edges being displaced from the ski body due to impact loading during use.

It is an advantage of the present invention that the improved ski structure provides a quicker responding ski or a ski that provides a faster change in ski turning direction.

It is another advantage of the present invention that the improved ski structure provides a softer flexing, livelier high performance ski.

It is a further advantage of the present invention that the improved ski structure imparts increased torsional rigidity to the ski.

It is yet another advantage of the present invention that the improved ski structure provides a soft flexing ski with a high return rate which possesses increased carving and holding characteristics across a snow or ice surface due to its increased torsional rigidity tuned in concert with the longitudinal flex.

These and other objects, features and advantages are obtained by providing in a snow ski reinforcement rib members positioned generally perpendicularly to the top surface and the bottom running surface of the ski and interiorly of the two opposing sides, the reinforcement rib members being formed from a material of relatively high Young's modulus in flexure with respect to the modulus of the core material so that a designably increased rate of return and a controllably designed natural frequency is imparted to the ski.

BRIEF DESCRIPTION OF THE DRAWINGS

The advantages of this invention will become apparent upon consideration of the following detailed disclosure of the invention, especially when it is taken in conjunction with the drawings wherein.

DETAILED DESCRIPTION

Figure 1:
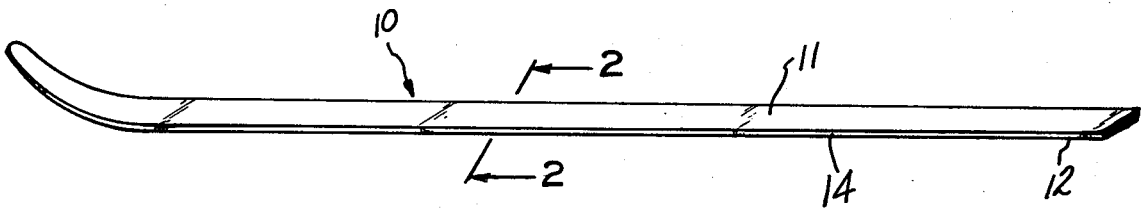
FIG. 1 is a side perspective view of a snow ski incorporating the structure of the present invention.

Referring to FIG. 1 there is seen in side perspective view a ski 10 having a top surface 11, a bottom surface 12 and two opposing side surfaces 14 (only one of which is shown).

Figure 2:
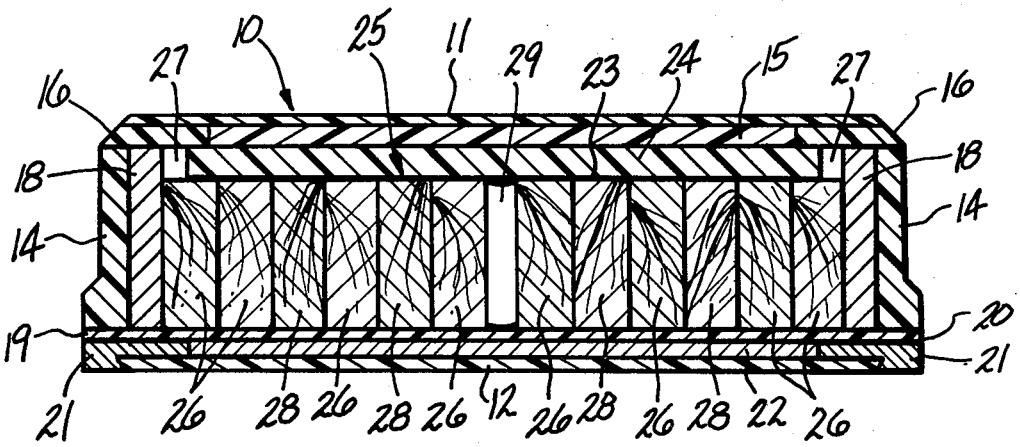
FIG. 2 is a sectional view taken along the line 2—2 of FIG. 1 showing the improved ski structure of the present invention.

FIG. 2 shows in a sectional view the structure of the invention. The top surface 11 is a sheet or layer of acrylonitrile butadiene styrene (ABS). Beneath the top surface 11 in the central portion of the ski 10 is a layer of unidirectional fiberglass 15 of predetermined thickness. Adjacent this unidirectional fiberglass layer 15 on both peripheral edges are the plastic top edges 16 that run the entire length of the ski. The use of plastic in the top edges 16, as opposed to a metal in a solid bottom edged ski, such as aluminum, serves to reduce the strain in the bottom edges 21 for the same implied load. Adjacent to each of the opposing sides 14 are perpendicularly extending reinforcement rib members 18 that run from the plastic top edges 16 to the bottom layer of unidirectional fiberglass 19. The opposing sides 14 are comprised of ABS and serve to protect the reinforcement rib members 18 as well as to form an outer surface of the ski. The bottom layer of unidirectional fiberglass 19 also serves to provide stiffness to the ski. Beneath this layer 19 is a layer of rubber foil 20 that extends across the entire width of the ski. The rubber foil layer 20 helps bond the steel bottom edges 21 to the opposing sides 14 and the rib members 18, as well as helping to control the vibrations within the ski 10 during use.

Bottom edges 21 beneath the rubber foil layer 20 may be either a solid edge or a cracked edge as desired. It is known that a solid edge imparts more vibration to the ski, keeping all other design factors constant, and permits the surface tension between the bottom surface 12 and the snow to be broken. If the bottom edges 21 are cracked, as is well known in the art, less vibration is transmitted to the ski.

Interiorly of the bottom edges 21 is an inner bottom layer 22 formed of either polyethylene or aluminum. Where aluminum is used, such as in a giant slalom ski, the vibrational characteristics of the ski are enhanced by increasing the natural frequency of the ski. In this type of a ski, it is desirable to break up the surface tension or water suction between the bottom running surface 12 of the ski and the snow. The polyethylene is used as a filler in this inner bottom layer where a higher natural frequency is not needed. The bottom surface 12 of the ski 10 is comprised of polyethylene and forms the major contact surface with the snow.

Looking again at the top surface of the ski 10, there is seen a layer 24 beneath the unidirectional fiberglass layer 15 which is formed of polyester and random fiberglass in the binding plate area. This is utilized only in the binding plate area to add screw retention strength to the ski when the bindings are mounted. Outside the binding area, this layer is replaced by the wood of the core, indicated generally by the numeral 25. Beneath the layer 24 of polyester and random fiberglass in the binding plate area is a layer of binding foil 23. This binding foil layer 23 compensates for any mismatched tolerances in the wood core 25, as well as its principal purpose of increasing the binding pull out strength. The binding foil layer 23 may be made from any suitable elastomeric material, although rubber or ionomer are preferred. When compressed under the pressure of a press, the rubber or ionomer acts as a film adhesive that helps to bond layer 24 to the core 25. Adjacent the layer 24 of polyester and random fiberglass and between the rib members 18 on opposing sides are air spaces 27. These spaces are also only found in the binding plate area.

The core 25 is formed from a plurality of layers of aspen and birch which are laminated together so that the layers are generally perpendicular to the top surface 11 and the bottom surface 12. On the outermost portion of the core adjacent the rib members 18 are two adjacently positioned layers of aspen 26 that are laminated together by an appropriate adhesive. Adjacent these layers of aspen is a layer of birch 28. In alternating sequence, subsequent layers of aspen, birch, and aspen are also laminated together. Separating the two interior aspen layers 26 of the wood core 25 is a wedge space 29 that is narrow in the center of the ski but widens as the opposing ends of the ski 10 are approached. Wedge space 29 is hollow air space into which are emplaced approximately three wedges (not shown) so that the core sticks or alternating layers of birch and aspen can be bent or formed during manufacture of the ski to conform to the side cut or geometry of the ski. It is this side cut or geometry plus the flexural pattern of the ski which defines the turning radius of a ski.

Figure 3:
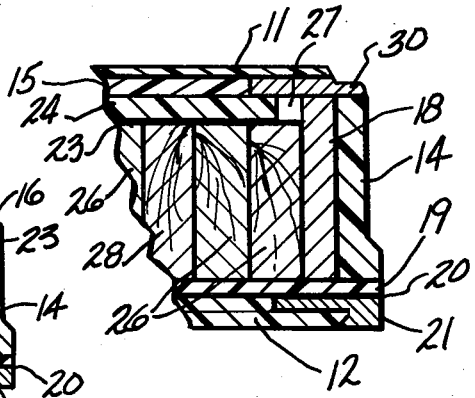
FIG. 3 is a partial sectional view showing an alternative embodiment of the top edges employed in the ski of the present invention.

FIG. 3 shows in a partial view an alternative design that may be employed with the top edges. The structure previously described has added thereto top edges 30 (only one of which is shown). Top edge 30 has routing along its exterior and top surface 11, as opposed to the smoothly tapered design shown in FIG. 2. Additionally, the top edges 30 may be formed from aluminum.

Figure 4:
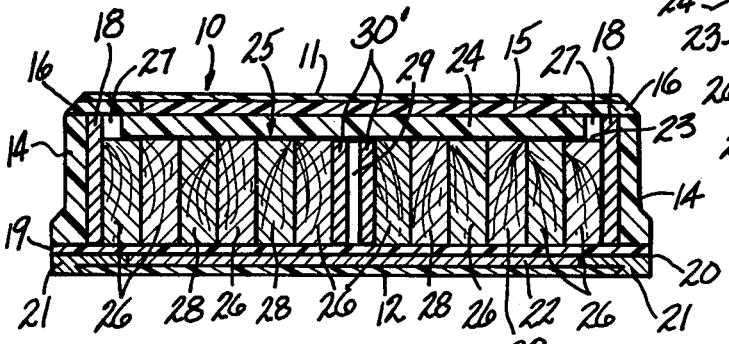
FIG. 4 is a sectional view showing an alternative embodiment of the improved ski structure of the present invention.

FIG. 4 shows an alternative embodiment employing two sets of rib members, exteriorly positioned rib members 18 and a second set of interiorly positioned rib members 30'. The interiorly positioned rib members 30' are placed on opposing sides of the wedge space 29 and further enhance the ski return rate and torsional reinforcement.

It should be noted that the rib members 18 and 30' may be formed either from graphite, aluminum, aramid, boron or other appropriate material. The key consideration is forming the ribs from a high modulus material incorporated into a relatively low modulus wood core to develop a ski with an increased return of snap and a more lively feel at lower overall center spring constant to create a quicker responding ski or a ski that provides faster changes in turning direction.

This result is achieved because of the relationship between Young's modulus of flexure for the materials employed where conditions are such that the constant of proportionality of flexure or elasticity may be described by the equation $E=(\tau/\epsilon)$. Thus, as envisioned by the present invention a wood core is known to have a Young's modulus of about $1\times10^6$ pounds per square inch (psi). Graphite in a composite has a Young's modulus of about $20.4\times10^6$ psi, while aluminum's is about $10.4\times10^6$ psi. Thus the operable range for the ratio of the modulus of the reinforcement rib to the core is from about 25 to 1 to about 8 to 1, while the preferred range is from about 12 to 1 to about 9 to 1. The optimum material has a high Young's modulus to density ratio where the density of the materials as employed approximately are 0.40 for wood, 1.30 for composite graphite and 2.61 for aluminum.

The center spring constants of the skis of the present design have been found to be from about 18 pounds per inch to about 21 pounds per inch for skis ranging from about 190 centimeters to about 205 centimeters in length. These center spring constants were measured by a 500 pound capacity load cell connected to a Doric transducer having a digital readout in conjunction with a direct current driven Saginaw gear predetermined displacement force device. The predetermined displacement employed was about one inch.

The increased bottom steel edge impact resistance achieved by the design of the reinforcement rib members provides a ski of greater durability. This results from impact energy being transmitted through the bottom edges 21 and the layer 19 of unidirectional fiberglass to the reinforcement ribs. The compressive impact energy is then dissipated along the length of the rib, which extends along the entire snow contact surface of the ski. This results in the dispersion of the impact stress concentration to prolong the life of the bottom steel edges 21 and the bottom surface 12.

It should also be noted that the rib reinforcement members can be bonded to the other core components prior to ski molding or during the molding process in the production of the ski. This construction technique has been applied to a laminated construction, but can also be used in a wet wrap or injection molded production process.

While the preferred structure in which the principles of the present invention have been incorporated is shown and described above, it is to be understood that the invention is not to be limited to the particular details thus presented but, in fact, widely different means may be employed in the practice of the broader aspects of this invention. The scope of the appended claims is intended to encompass all obvious changes in the details, materials and arrangements of parts that will occure to one of ordinary skill in the art upon a reading of this disclosure.

Having thus described the invention, what is claimed is:

1. In a snow ski of predetermined length with a wooden core with a known modulus of elasticity having a top surface, a bottom running surface bounded on its opposing sides by metal edges and two opposing sides positioned generally perpendicularly to the top and bottom surfaces and intermediate thereof, the improvement comprising:

at least two reinforcement rib members positioned generally perpendicularly and connected to the top and bottom surfaces interiorly of the two opposing sides, the reinforcement rib members being formed from aluminum with a relatively high modulus of elasticity in comparison to the core giving a high ratio of the modulus of elasticity for the combined material of the reinforcement rib members and the wooden core to the density for the combined material of the reinforcement rib members and the wooden core so that an increased rate of return and a controllably designed natural frequency is imparted to the ski.

2. The apparatus according to claim 1 wherein the reinforcement rib members are positioned between the core and the two opposing sides.

3. The apparatus according to claim 1 wherein the core has a predetermined width with a wedge space extending substantially the predetermined length of the ski to divide the predetermined width of the core equally into two parts.

4. The apparatus according to claim 3 further comprising two additional reinforcement rib members, one each being positioned on each side of the wedge space and extending generally perpendicularly to the top surface and the bottom running surface.

5. The apparatus according to claim 4 wherein the two addtional reinforcement members are formed from aluminum.

6. The apparatus according to claim 5 wherein the ratio of the modulus of the material of the reinforcement rib members to the core material is greater than about 8 to 1.

7. In a snow ski of predetermined length having in combination:

(a) a top surface;

(b) a bottom running surface with two opposing sides and bounded thereon by bottom metal edges extending the predetermined length of the ski;

(c) two opposing sides positioned generally perpendicularly to the top surface and the bottom running surface;

(d) a core of predetermined width formed from wooden material of known modulus of elasticity positioned centrally between the two opposing sides;

(e) top edges formed from a predetermined material at least partially beneath the top surface adjacent and above the two opposing sides extending substantially the predetermined length of the ski;

(f) a layer of material of predetermined selection at least partially above the bottom metal edges and of predetermined thickness;

(g) a layer of bonding material between the layer of material of predetermined selection and the bottom metal edges; and (h) at least two reinforcement rib members positioned exteriorly of the core and adjacent and interiorly of the two opposing sides extending a distance less than the predetermined length of the ski connected on a first end to the top edges and on a second end to the layer of material of predetermined selection, the reinforcement rib members further being positioned generally vertically to the top surface and the bottom running surface and being formed from aluminum of predetermined thickness with a known modulus of elasticity that is relatively high in comparison to the modulus of elasticity of the core of wooden material to impart an increased rate of return and controllably designed natural frequency to the ski.

8. The apparatus according to claim 7 wherein the core has a wedge space extending substantially the predetermined length of the ski to divide the predetermined width of the core equally into two parts.

9. The apparatus according to claim 8 further comprising two additional reinforcement rib members, one each being positioned on each side of the wedge space and extending generally perpendicularly to the top surface and the bottom running surface.

10. The apparatus according to claim 9 wherein the two additional reinforcement members are formed from aluminum.

11. The apparatus according to claim 10 wherein the ratio of the modulus of the material of the reinforcement rib members to the core material is greater than about 8 to 1.

12. The apparatus according to claim 7 wherein the top edges are formed from a plastic material.

13. The apparatus according to claim 12 wherein the layer of material of predetermined selection is comprised of unidirectional fiberglass.

* * * * *

UNITED STATES PATENT AND TRADEMARK OFFICE

CERTIFICATE OF CORRECTION

PATENT NO. : 4,455,037

DATED : June 19, 1984

INVENTOR(S) : Edward D. Pilpel, Franklin D. Meatto

It is certified that error appears in the above-identified patent and that said Letters Patent is hereby corrected as shown below:

Column 4, line 63, "E=($\tau/\epsilon$)" should be --E=($\sigma/\epsilon$)--.

Signed and Sealed this

*Twenty-third* Day of *October 1984*

[SEAL]

*Attest:*

GERALD J. MOSSINGHOFF

*Attesting Officer*

*Commissioner of Patents and Trademarks*